US008371137B2

(12) United States Patent
De Ryckel et al.

(10) Patent No.: US 8,371,137 B2
(45) Date of Patent: Feb. 12, 2013

(54) SHADING PANEL FOR DISPLAY SYSTEM

(75) Inventors: Antoine De Ryckel, Ohey (BE); Bernd Wolfvelde, Zwevegem (BE); Koen Ooghe, Gent (BE); Bao Chun Lu, Bejing (CN); Yong Qiang Kang, Beijing (CN)

(73) Assignee: Barco Visual (Beijing) Electronics Company Limited, Beijing (CN)

( * ) Notice: Subject to any disclaimer, the term of this patent is extended or adjusted under 35 U.S.C. 154(b) by 155 days.

(21) Appl. No.: 12/921,012

(22) PCT Filed: Mar. 7, 2008

(86) PCT No.: PCT/CN2008/070439

§ 371 (c)(1),
(2), (4) Date: Mar. 10, 2011

(87) PCT Pub. No.: WO2009/109083

PCT Pub. Date: Sep. 11, 2009

(65) Prior Publication Data

US 2011/0267811 A1 Nov. 3, 2011

(51) Int. Cl.
*F21V 1/00* (2006.01)
*G02B 27/02* (2006.01)

(52) U.S. Cl. ..... 62/235; 359/601

(58) Field of Classification Search ..... 362/245, 362/290, 342, 230, 235; 359/601
See application file for complete search history.

(56) References Cited

U.S. PATENT DOCUMENTS

2007/0165162 A1 7/2007 Meersman et al.

FOREIGN PATENT DOCUMENTS

CN 2845074 Y 12/2006
CN 2888571 Y 4/2007
JP 8234984 A 9/1996

OTHER PUBLICATIONS

International Search Report in PCT/CN2008/070439, Dec. 18, 2008.
Examination Report of IPO of PRC regarding CN 200880127992.7, Oct. 19, 2011.
International Preliminary Report on Patentability in PCT/CN2008/070439, Sep. 7, 2010.
Communication of the EPO regarding European Patent application No. 08715175.9, Feb. 23, 2011.
Supplemental Search Report of the EPO regarding European Patent application No. 08715175.9, Mar. 14, 2011.

*Primary Examiner* — Anh Mai
*Assistant Examiner* — Elmito Breval
(74) *Attorney, Agent, or Firm* — Bacon & Thomas, PLLC

(57) ABSTRACT

A shading panel is described for shading light emitting elements of a light emitting diode display system. The shading panel defines a substantially plane panel surface having an upper border and a lower border, the shading panel comprising at least one column of at least two openings aligned according to a column direction, each opening being suitable to receive at least one light emitting element. For each pair of adjacent openings of the at least one column of openings, the shading panel comprises a first shading louver and a second shading louver, the first shading louver being positioned closer to the opening of the pair of openings closest to the upper border, the second shading louver being positioned closer to the opening of the pair of openings closest to the lower border. The height of the first shading louver is smaller than the height of the second shading louver.

14 Claims, 4 Drawing Sheets

SHADING PANEL FOR DISPLAY SYSTEM

TECHNICAL FIELD OF THE INVENTION

The present invention relates to shading panels for shading light emitting elements of display systems, and to display systems, more particular outdoor display systems, comprising light emitting elements, aligned according to a column direction and being provided with shading panels for shading the light emitting elements.

BACKGROUND OF THE INVENTION

Display systems nowadays become more and more important in daily life, not only for providing advertisement to a broad public, but also as a means to provide information and entertainment to the public, e.g. large display systems used to show life images of outdoor happenings, concerts, sport happenings and alike.

Very often the display systems are positioned outdoor or in situations where light sources may provide light which is incident to the light emitting surface of the display system. Such light sources may be sunlight or light from illumination systems present near the display system.

In order to avoid or reduce reflection of incident illumination on the light emitting surface of the surface towards the audience looking to the light emitting surface of display system, comprising the light emitting elements, it is known to use shading panels or shading devices, such as shown in US2007/0165162A1. These panels help blocking light emission of direct and indirect light sources toward the audience.

The shading device is provided using a significant amount of additional material.

Shading devices typically block incident light falling onto the light emitting surface of the display system. Very often louvers are positioned between the light emitting elements. In order to provide sufficient shading, the dimension of the louvers are to be high enough to provide shading for light incident angles of typically 45°, along the surface between two louvers, one positioned above the other. Such dimensions however also reduce the visibility of the light emitting elements for the audience.

Similar as the shading angle, the height of the louver will also define the minimum viewing angle for the audience. The louver will prevent the audience positioned under an angle relative to the panel surface of less than this minimum visibility angle, from viewing the light emitting elements. The louvers hence influence the visibility of the image generated on the light emitting surface of the display system by means of the light emitting elements, more particular the visibility of the light emitting elements of the light emitting surface for the audience. To allow the audience to be closer to the light emitting surface of the display system, the louvers should be shorter. This however is contradictory to the need to provide higher louvers for improving the shading of the light emitting elements.

SUMMARY OF THE INVENTION

It is an object of embodiments of the present invention to provide good shading panels for shading display systems comprising light emitting elements.

The shading panels as subject of the present invention have the advantage that the height of the louvers of the shading panels can be reduced, while still providing good shading to the light emitting elements of the display system to which it can be mounted or of which it forms part of.

A shading panel according to the present invention accomplishes the above objective. The present invention provides a shading panel for shading light emitting elements of a light emitting diode display system, the shading panel defining a substantially plane panel surface having an upper border and a lower border. The shading panel comprises at least one column of at least two openings aligned according to a column direction, each opening being suitable to receive at least one light emitting element. For each pair of adjacent openings of the at least one column of openings, the shading panel comprises a first shading louver and a second shading louver. The first shading louver is positioned closer to the opening of the pair of openings closest to the upper border, the second shading louver being positioned closer to the opening of the pair of openings closest to the lower border. The height of the first shading louver is smaller than the height of the second shading louver.

A louver is to be understood as a finned or vaned device, typically used for controlling the emission of light.

The column direction, i.e. the direction of the column or columns of openings, is defined by the direction of alignment of the opening between the lower border and the upper border. The openings may be suitable to receive only one light emitting element or to receive only one group of light emitting elements, e.g. a group of three LED's, i.e. a red light emitting LED, a blue light emitting LED and a green light emitting LED, or may have the form of a slit extending in a direction perpendicular to the column direction, hereafter referred to as the row direction.

The height of a louver is the maximum distance between a point of the louver and the panel surface measured in the direction perpendicular to the panel surface.

As the second louver is larger than the first louver and positioned closer to the opening of the pair of openings closer to the lower border, the height of the second louver will define the shading angle of the shading panel. The shading angle is the maximum angle of incident light made between the panel surface of the shading panel and a light source providing the incident light, under which incident light will be prevented from falling onto the light emitting elements located in the openings. Usually a shading angle of 45° is to be respected.

The presence of the first louver between the opening of the pair of opening closer to the upper border, and the second louver, will cause that at least part of the panel surface between the opening of the pair of openings closer to the upper border and the second louver positioned closer to the lower border, may be shaded by means of the first louver. Hence the height of the second louver must no longer be such that the complete section of the panel surface between two adjacent second louvers is to be shaded by the second louver.

The shading angle and the minimum visibility angle are measured in a plane perpendicular to the panel surface and parallel to the column direction. Heights of the first and second louver are optionally less than 12 mm, optionally less than 10 mm.

Each of the first and second louvers can have an upper surface oriented to the upper border, the two openings being spaced at a pitch, the height of the second louver is more or equal to the difference of the pitch and the minimum distance between the upper surface of the first louver and the upper surface of the second louver.

The pitch is the distance between two adjacent openings in column direction. It is measured by determining the distance between the two geometric centres of the surfaces of the two openings. When light emitting elements are mount in the openings, the pitch corresponds to the pitch between the two light emitting elements. The openings, first and second louvers may be spaced at regular distance one from the other in the column direction. The regular spacing of similar elements, called pitch, may range from 3 mm up to 30 mm; the light emitting element may have a diameter of about 8 mm.

Each of the first and second louvers has an upper surface oriented to the upper border, a lower surface oriented to the lower border, both upper and lower surface providing a coupling edge where the louver contacts the panel surface. Opposite to the coupling edges, the louvers have a face surface, which optionally may be substantially parallel to the panel surface, or which may be oriented under an angle with the panel surface, the face surface be facing towards the lower border. The latter orientation reduces light reflection of incident light towards the audience when the shading panel is used to shade light emitting elements of a display system, i.e. when the shading panel is part of such a display system.

Typical distances between the upper surface of the first louver and the light emitting element of the pair of light emitting elements, e.g. LED's, positioned closer to the upper border, when provided in the openings, is at least 2 mm, such as 2 mm or 3 mm. Such distances may avoid liquids, such as rain droplets, to adhere between the light emitting element and the first louver.

A plurality of openings may be positioned on the shading panel surface according to a matrix of N×M openings, comprising M columns of openings oriented according to said column direction and N rows of openings oriented according to a row direction, M being more than 1.

The openings, typically each for receiving one light emitting element or a group of light emitting elements, e.g. a red light emitting LED, a blue light emitting LED and a green light emitting LED, are typically positioned on the shading panel surface according to a matrix of N×M openings, i.e. M columns and N rows of openings.

The column direction and row direction are typically perpendicular. Together they define the plane of the panel surface.

The first louver and/or the second louver can be interrupted between adjacent pairs of openings of adjacent columns of openings.

In case of openings arranged according to a matrix of N×M openings, with rows being in a substantially identical direction, i.e. a row direction, and with columns being in a substantially identical direction, i.e. the column direction, the louvers may extend from one side border of the shading panel to the other side border of the shading panel, without interruption, between adjacent pairs of adjacent columns of openings. Alternatively, the first and second louvers may be interrupted between adjacent pairs of adjacent columns, which may facilitate removal of droplets of liquid away from the light emitting elements provided in the openings, e.g. rain in case of outdoor shading panels. First respectively second louver sections may be provided with such interruptions. The interruption may optionally be only a reduction of the louver height.

Optionally the first and/or second louver may have a height along the louver length being substantially identical along the length of the louver. This makes the production of the shading panel and louvers easier.

The first and/or second louver may be provided with a given thickness in column direction. Optionally the first and/or second louver may have a thickness along the louver length being substantially identical along the length of the louver.

The second louver can have a curved shape. The first and/or second louvers, in particular the second louver, may be provided as substantially straight vanes of fins, or may have a curved shape. The radii of curvature of the curved shape are oriented towards the lower border.

Optionally, the second louver is interrupted between adjacent pairs of openings of adjacent columns of openings providing second louver sections, the radii of curvature of the curved shape are oriented towards the lower border.

In order to reduce incident light falling upon zones of the panel surface other than zones provided by the openings, for each section of the shading panel according to a plane perpendicular to the plane surface and parallel to the column direction and providing an intersection with the first louver and the second louver the distance in a direction parallel to the column direction of the point of the intersection of the first louver farthest remote from the panel surface with the intersection of the second louver is less than or equal to the distance perpendicular to the surface plane between the point of the intersection of the first louver farthest remote from the panel surface and the panel surface, i.e. the height of the first louver.

The point of the intersection of the louver farthest remote from the panel surface is the point of the intersection, which is located on the largest distance to the panel surface measured in the direction perpendicular to the panel surface.

The shading panel further may also comprise a third louver positioned between the first louver and the opening of the pair of openings closest to the upper border, the height of the third louver being less than the height of first louver. This third louver reduces, even may avoid light of the light emitting element of the pair of light emitting elements closest to the upper border to fall on the upper surface of the first louver, when light emitting elements of a display system are positioned in the openings.

Optionally the panel surface and if present, the upper surface, the lower surface and/or the face surface of the first and/or second louver may be roughened to reduce the reflection of light falling in upon the surface. The roughening may be provides as a saw-like, serrated surface structure. The serration has a triangular cross section, according to a plane perpendicular to the panel surface and parallel to the column direction, with a first face of the triangle parallel to the panel surface, the second face oriented substantially perpendicular to the panel surface, e.g. sloping downwards less than 10° and the third face making an angle as small as possible with the second face, e.g. less than 60° with respect to the horizontal. The serrations cause incident light to reflect several times before light is reflected back to the audience. This repetitive reflection causes scattering of the reflection and reduces the intensity of the emitted light.

The preferred process for making the shading panel is plastic injection moulding. The smallest reachable dimensions are related to the material used. For an outdoor environment, a preferred material is polycarbonate. The smallest thickness achievable is related to the mould flow and can be around 2 mm. The smallest dimensions of the serration can be around 0.3 mm. The shading panel can be provided as a single element, easily removable for service reasons. Different ways of fixation can be used e.g. screws or a clickable or snap-on system, e.g. using a small hook for clicking on the display The display system may comprise at least two light emitting elements, whereby each of the at least two openings encompasses one of said at least two light emitting elements.

For each section of the shading panel according to a plane perpendicular to the plane surface and parallel to the column direction and providing an intersection with the first louver, the second louver and the light emitting element of the pair of light emitting elements positioned closer to the upper border, the imaginary line passing through the point of the intersection of the first louver farthest remote from the panel surface and the point of the intersection of the second louver farthest remote from the panel surface does not intersect with intersection of the light emitting element.

The effect is that the first louver, i.e. the louver with the smallest height, will define the minimum angle of the shading panel under which the light emitting elements are visible for the audience. This "minimum visibility angle" is the largest angle between the panel surface of the shading panel and a person in the audience, the shading panel being mounted with its panel surface substantially vertical and its upper border oriented upwards, under which angle the audience, located at a level below the lower border, will not see any part of the light emitting elements. The first louver will prevent the audience positioned under an angle relative to the panel surface of less than this minimum visibility angle, from viewing the light emitting elements. An angle of 90° between panel surface of the shading panel and audience means the audience looking to the shading panel in a direction perpendicular to the panel surface. The first louvers hence influence the visibility of the shading panel, more particular the visibility of the light emitting elements of the shading panel for the audience.

A plurality of light emitting elements can be positioned on the shading panel surface according to a matrix of N×M light emitting elements, comprising M columns of light emitting elements oriented according to said column direction and N rows of light emitting elements oriented according to a row direction, M being more than 1.

The light emitting elements of one row of light emitting elements may be provided within one opening, e.g. an elongate or slit like opening, elongated in row direction. Each of the light emitting elements may be provided in a plurality of openings, the openings being positioned on the shading panel surface according to a matrix of N×M openings.

The first louver and/or the second louver can be interrupted between adjacent pairs of light emitting elements of adjacent columns of light emitting elements.

The second louver can be interrupted between adjacent pairs of light emitting elements of adjacent columns of light emitting elements providing second louver sections, the second louver sections being curved. The radii of curvature of the curved shape can be oriented towards the lower border.

The interruptions and/or the curved shapes, with radii of curvature oriented to the lower border, may avoid liquid droplets, e.g. rain droplets, to remain present near the light emitting elements. The provision of interruptions facilitates more easily the removal or evacuation of liquid droplets from the light emitting surface of the display system.

The shading panel may further comprise a third louver positioned between the first louver and the opening of the pair of openings closest to the upper border, the height of the third louver being less than the height of first louver, the light emitting element of the pair of light emitting elements closest to the upper border.

This third louver reduces, even may avoid light of the light emitting element of the pair of light emitting elements closest to the upper border to fall on the upper surface of the first louver.

The second louver preferably shades the light emitting element of the pair of light emitting elements, located closer or closest to the bottom border, from incident external light falling on the panel surface at a light incident angle between 0° and 45°.

The incident angle is measured for incident light rays falling on the plane surface according to a plane perpendicular to panel surface and parallel to the column direction.

An advantage is that the function of shading of the light emitting elements, hence the definition of shading angle, and the definition of the minimum visibility angle are made less dependent on one another, hence providing more degrees of freedom for designing the shading panel according to particular needs and requirements.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
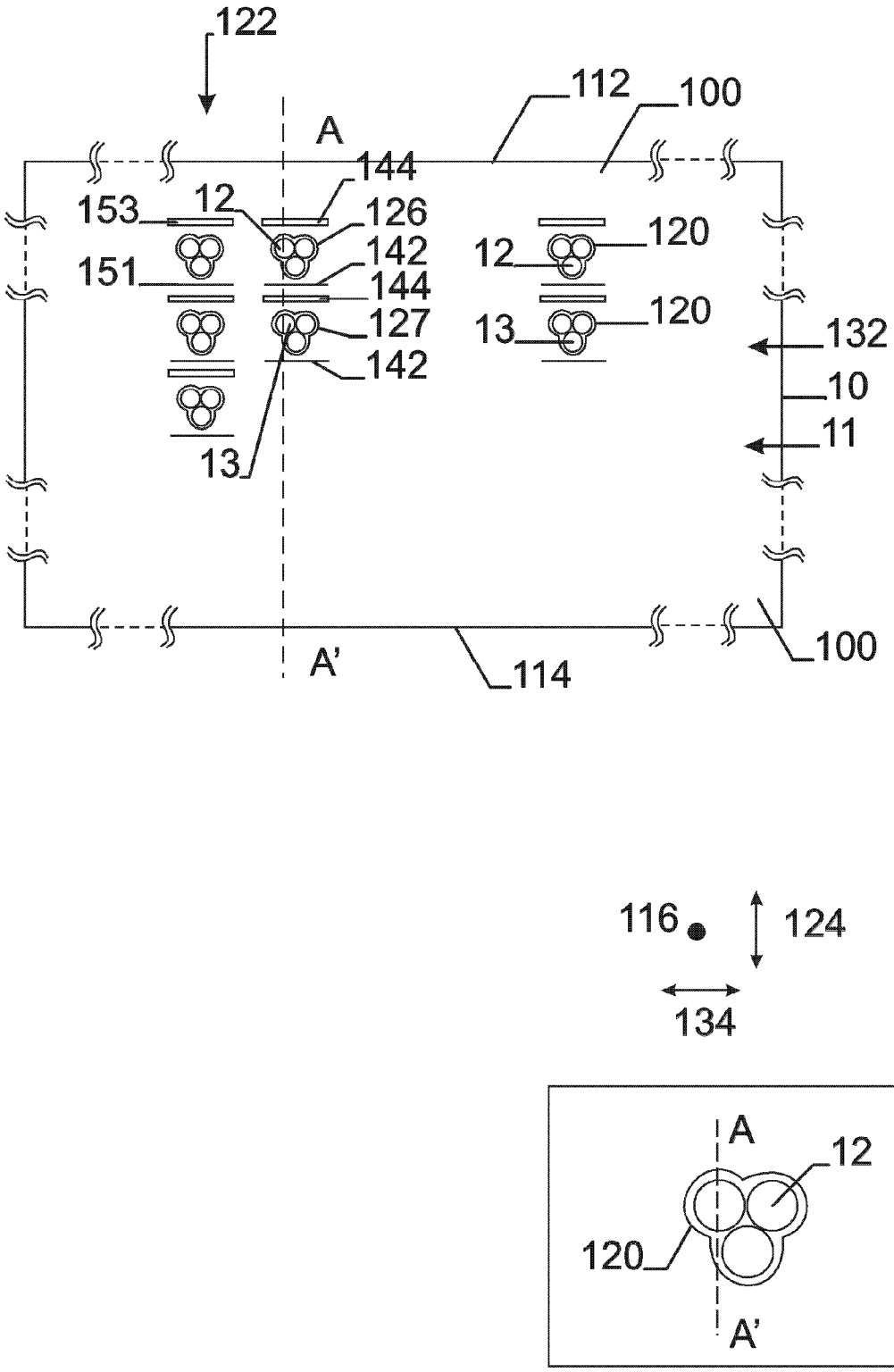
FIG. 1 is a schematic representation of a planar view of a display system comprising a shading panel according to an embodiment of the present invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. The terms "coupled" and "connected", along with their derivatives, may be used. It should be understood that these terms are not intended as synonyms for each other. Thus, the scope of the expression "a device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

FIG. 1 shows schematically a face view of an embodiment of a shading panel 100 according to the present invention, being part of a display system 10. A cross section according to a plane AA' perpendicular to the panel surface and parallel to the column direction, of a first embodiment of a shading panel 100 is shown schematically in FIG. 2.

A shading panel 100 is defined by a substantially plane panel surface 110 having an upper border 112 and a lower border 114. The shading panel 100 comprises a plurality of columns 122 and or rows of openings 120 aligned according to a column direction 124 and/or a row direction respectively. The openings 120 are positioned on the shading panel surface 110 according to a matrix of N×M openings 120, i.e. M columns 122 and N rows 132 of openings 120. The display system 10 provides in each opening one or more light emitting elements 12 or 13, in this embodiment comprising a plurality of LED's e.g. three LED's, each LED emitting a primary colour, e.g. one LED emitting green light, one emitting red light and one emitting e blue light. As such a full colour display system is provided. Each opening 120 is provided with one light emitting element, comprising three or more such LED's. The light emitting elements 12 and 13 together cause the light emitted by the light emitting surface 11 of the display system 10.

As such, a plurality of columns 122 of light emitting elements 12 and 13, aligned according to a column direction 124 of the openings 120 may be provided and similarly a plurality of rows. The light emitting elements 12 and 13 are positioned in the openings 120 of the shading panel surface 110 according to a matrix of N×M light emitting elements 12 and 13, i.e. M columns 122 and N rows 132 of light emitting elements 12 and 13.

The column direction 124 may be intended to be substantially parallel to the vertical when the shading panel 100, being part of a display system 10, is in use. The row direction 134 may be intended to be substantially horizontal when the shading panel 100, being part of a display system 10, is in use. The column direction 124 and row direction 134 are typically perpendicular. Together they define the plane of the panel surface 110.

The shading panel 100 shades the light emitting elements 12 and 13 located within the openings 120 while at the same time allowing the audience to view the display on the panel generally from a position lower than the display.

Figure 2:
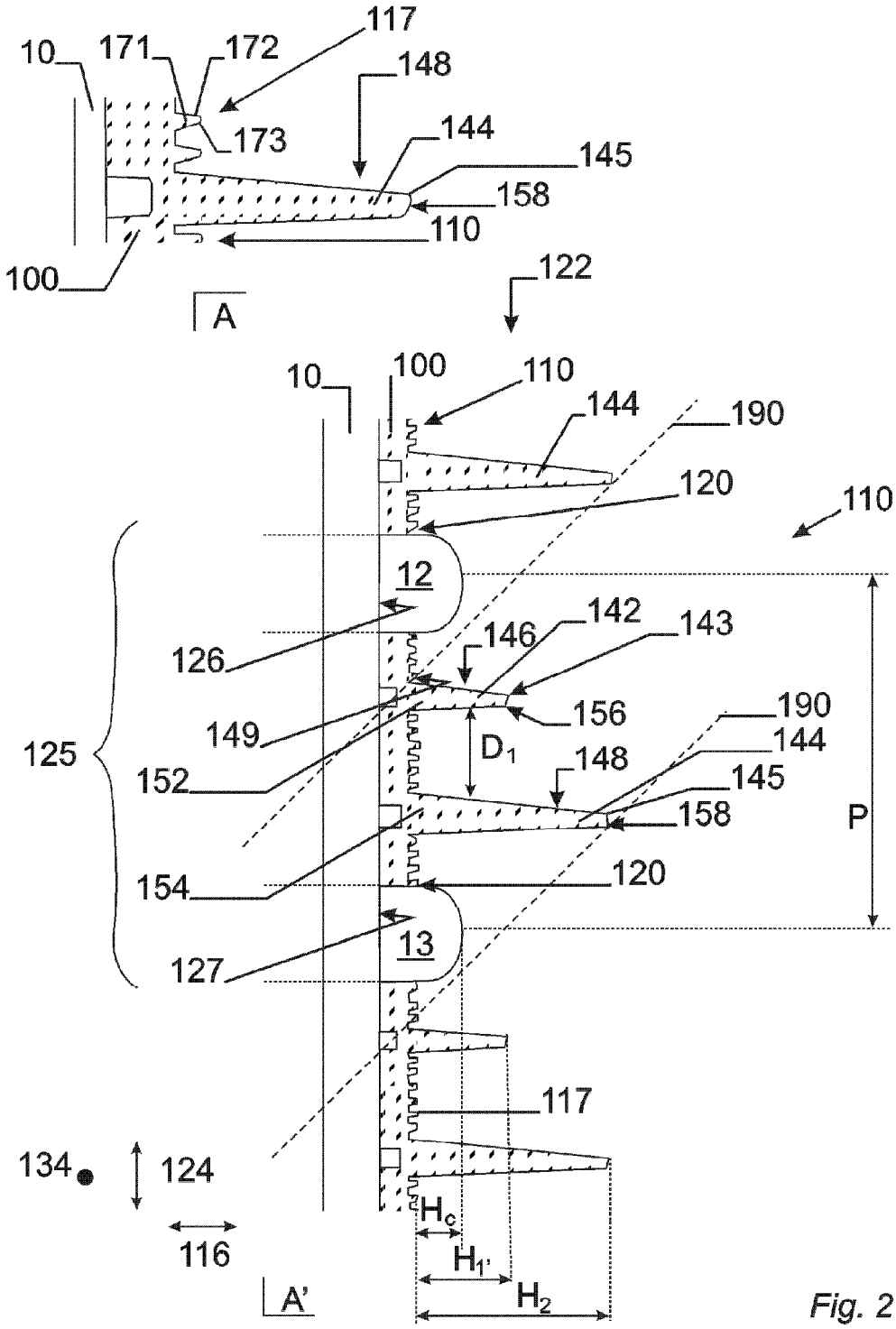
FIG. 2 is a cross section according to a plane AA' of the display system comprising the shading panel of FIG. 1.

For each pair 125 of adjacent openings 120 in the column 122 of openings 120, as best visible in FIG. 2, the shading panel 100 comprises a first shading louver 142 and a second shading louver 144.

The first shading louver 142 is positioned closer to the opening 126 of the pair 125 of openings closest to the upper border 112. The second shading louver 144 is positioned closer to the opening 127 of the pair 125 of openings closest to the lower border 114.

The height H1 of the first shading louver 142 is smaller than the height H2 of the second shading louver 144.

The height H1 of the first louver 142 is the maximum distance between a point of the intersection of the first louver 142 and the panel surface 110, i.e. the distance between the point 143 of the intersection of the first louver 142, which point 143 is farthest remote from the panel surface 110 measured in the direction 116 perpendicular to the panel surface 110. This direction 116 is parallel to the intersecting plane AA'.

The height H2 of the second louver 144 is the maximum distance between a point of the intersection of the second louver 144 and the panel surface 110, i.e. the distance between the point 145 of the intersection of the second louver 144, which point 145 is farthest remote from the panel surface 110 measured in the direction 116 perpendicular to the panel surface 110.

The first and second louvers have an upper surface 146 respectively 148 oriented to the upper border 112. The upper surface of the louver 142 is preferably at an angle sloping down of less than 10° to the horizontal. The lower surface of the louver 142 slopes upwards at an angle less than 60° to the horizontal, e.g. 45° or less, 30° or less, 20° or less, 10° or less. The two openings of the pair of openings are spaced at a pitch P. In fact, since light emitting elements 12 and 13 are provide in the openings 120, also the light emitting elements 12 and 13 are spaced at a pitch P. The height H2 of the second louver 144 is larger than the difference of the pitch P and the minimum distance D1 between the upper surface 146 of the first louver 142 and the upper surface 148 of the second louver 144. This causes the foot 149 of the first louver 142, i.e. the coupling point between panel surface 110 and first louver 142, to be shaded for incident light (indicated 190) falling under an angle of 45° on the shading panel 100. The light emitting element 13 located under the second louver 144 may be shaded completely when incident light is provided under an angle of 45°, in case the height HI of the light emitting element 13 and the position of the opening 127 are geometrically adapted to the position of the light emitting element 13. The complete volume of the light emitting element 13 may be positioned within the shade provided by the second louver 144.

Both the first louvers and the second louvers are interrupted between adjacent pairs of openings of adjacent columns 122 of openings. As such a plurality of aligned louver sections 151 respectively 153 are provided, aligned in row direction 134.

The first and second louvers 142 respectively 144, in particular louver sections 151 respectively 153, are provided as substantially straight vanes of fins.

Even when the shader is made of black material, e.g. black plastic, bright sunlight will reflect off it and will reduce the contrast of the displayed image. In accordance with embodiments of the present invention a plurality of louvers are used of different sizes to increase the shadowed regions on the top inclined surface of the louvers. The undersides of louvers are anyway in the shade so they do not contribute much reflected light. In order to reduce incident light falling upon zones of the panel surface other than zones provided by the openings for receiving the light emitting elements, for each section of the shading panel according to a plane perpendicular to the plane surface and parallel to the column direction, the distance in a direction parallel to the column direction of the point 143 of the intersection of the first louver 142 farthest remote from the panel surface 110 with the intersection of the second louver 142 is less than or equal to height H1 of the first louver 142.

Opposite to the coupling edges 152 respectively 154 of the first and second louver, the louvers 142 respectively 144 have a face surface 156 respectively 158, which is oriented at an angle with the panel surface 110, the face surfaces 156 respectively 158, be facing towards the lower border 114.

As best visible in the detail of FIG. 2, the panel surface 110 is provided with a saw-like, serrated surface structure 117. The serration has a triangular cross section, according to a plane perpendicular to the panel surface and parallel to the column direction, with a first face 171 of the triangle parallel to the panel surface 110, the second face 172 oriented substantially perpendicular to the panel surface 110, and the third face 173 making an angle as small as possible with the second face. The fineness of the serration can be dependent on the production process for manufacture of the shading panel surface. One preferred process is plastic injection moulding. The smallest reachable dimensions can also be related to the material used. For an outdoor environment for a panel with good impact resistance, a preferred material is polycarbonate. For injection moulding the smallest thickness achievable is related to flow of plastic material in the mould and is about 2 mm. The smallest dimensions of the serration may be around 0.3 mm.

The shading panel is preferably provided as a single element, easily removable for service reasons. Different ways of fixation are included within the scope of the invention e.g. using screws, or the shading panel may be adapted to clip-on the display.

Figure 3:
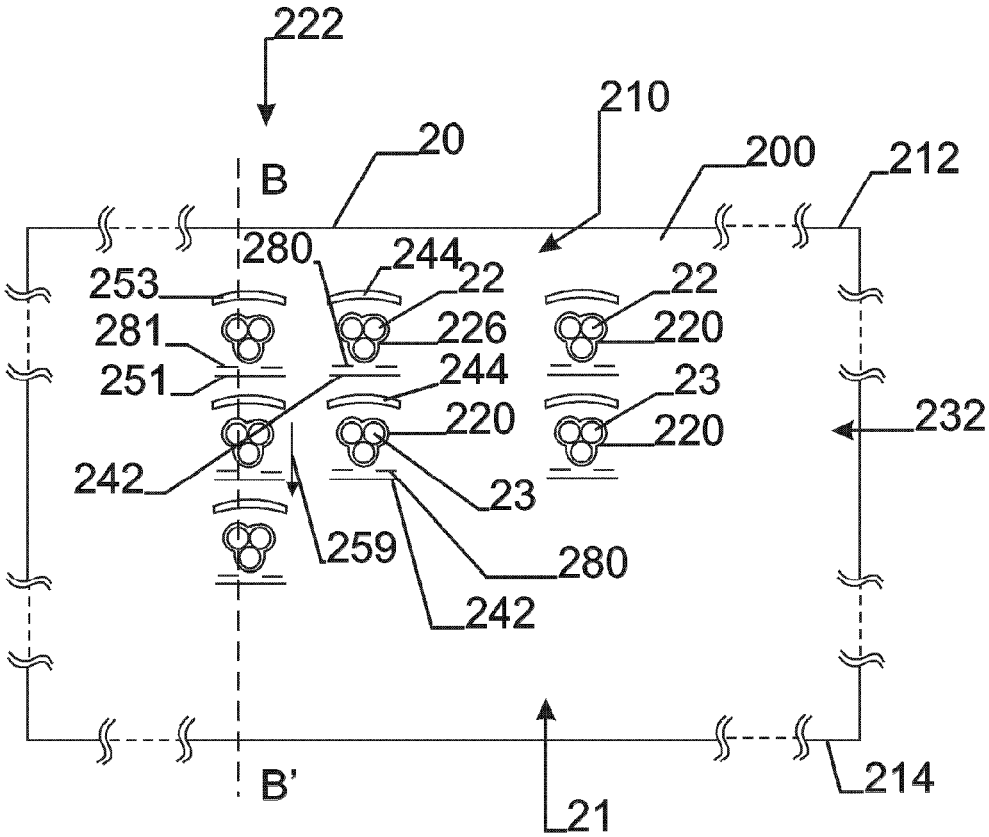
FIG. 3 is a schematic representation of a planar view of another display system comprising a shading panel according to an embodiment of the present invention.
Figure 3:
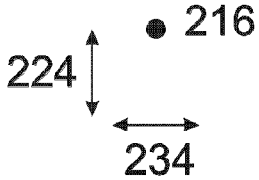

FIG. 3 shows schematically a face view of a second embodiment of a shading panel 200 according to the present invention being part of a display system 20, having a light emitting surface 21. A cross section according to a plane BB' perpendicular to the panel surface and parallel to the column direction, of a first embodiment of a shading panel 200 is shown schematically in FIG. 4.

A shading panel 200 defines a substantially plane panel surface 210 having an upper border 212 and a lower border 214. The shading panel 200 comprises a plurality of columns 222 of openings 220 aligned according to a column direction 224 and/or a plurality of rows aligned along a row direction. The openings 220 are positioned on the shading panel surface 210 according to a matrix of N×M openings 220, i.e. M columns 222 and N rows 232 of openings 220. The openings 220 and the arrangement of the openings 220 over the plane surface may be similar or identical as is the case for the openings 120 of shading panel 100 described above. Also the light emitting elements 22 and 23, may be similar or identical to the light emitting elements 12 and 13 of the display system 10 shown in FIG. 1 and FIG. 2. The display system 20 provides in each opening 220 a light emitting element 22 or 23, in this embodiment comprising three LED's, one LED emitting green light, one emitting red light and one emitting blue light. As by this way a full colour display system is provided. Each opening 220 is provided with one light emitting element, comprising three such LED's. The light emitting elements 22 and 23 together cause the light emitted by the light emitting surface 21 of the display system 20.

The column direction 224 may be intended to be substantially parallel to the vertical when the shading panel 200, forming part of a display system 20, is in use. The row direction 234 may be intended to be substantially horizontal when the shading panel 200, forming part of a display system 20, is in use.

The column direction 224 and row direction 234 are typically perpendicular. Together they define the plane of the panel surface. The shading panel 200 is provided to shade the light emitting elements 220.

Figure 4:
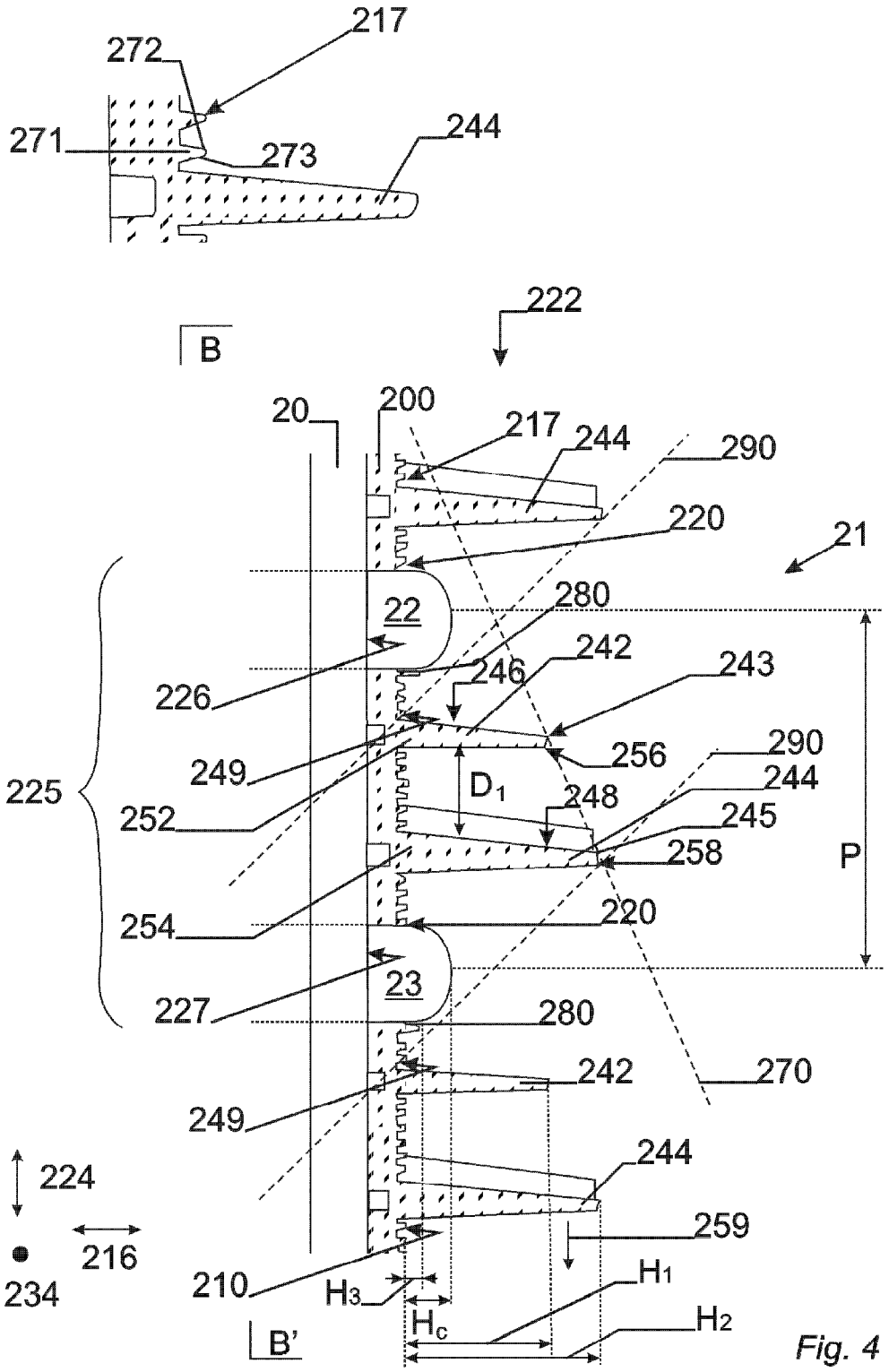
FIG. 4 is a cross section according to a plane BB' of the display system comprising the shading panel of FIG. 3.

For each pair 225 of adjacent openings 220 in the column 222 of openings 220, as best visible in FIG. 4, the shading panel 200 comprises a first shading louver 242 and a second shading louver 244, and further a third shading louver 280.

Similar as in the shading panel 100, the first shading louver 242 is positioned closer to the opening 226 of the pair 225 of openings closest to the upper border 212. The second shading louver 244 is positioned closer to the opening 227 of the pair 225 of openings closest to the lower border 214.

The height H1 of the first shading louver 242 is smaller than the height H2 of the second shading louver 244.

The height H1 of the first louver 242 is the maximum distance between a point of the intersection of the first louver 242 and the panel surface 210, i.e. the distance between the point 243 of the intersection of the first louver 242, which point 243 is farthest remote from the panel surface 210 measured in the direction 216 perpendicular to the panel surface 210. This direction 216 is parallel to the intersecting plane BB'.

The height H2 of the second louver 244 is the maximum distance between a point of the intersection of the second louver 244 and the panel surface 210, i.e. the distance between the point 245 of the intersection of the second louver 244, which point 245 is farthest remote from the panel surface 210 measured in the direction 216 perpendicular to the panel surface 210.

The third louver 280 is positioned between the first louver 242 and the opening 226 of the pair of openings 220 closest to the upper border 212. The height H3 of the third louver 280 is less than the height HI of the light emitting element 22 located in the opening 226 of the pair of openings closest to the upper border 212.

The first and second louvers have an upper surface 246 respectively 248 oriented to the upper border 212. The upper surface of the louver 242 is preferably at an angle sloping down of less than 10° to the horizontal. The lower surface of the louver 242 slopes upwards at an angle less than 60° to the horizontal, e.g. 45° or less, 30° or less, 20° or less, 10° or less. The two openings of the pair of openings are spaced at a pitch P. Similarly as set out with regard to the pitch of the openings in shading panel 100 in FIG. 1 and FIG. 2, the light emitting elements 22 and 23 are provided on a pitch P as well. For each section with a plane BB', the height H2 of the second louver 244 is larger than the difference of the pitch P and, the minimum distance D1 between the upper surface 246 of the first louver 242 and the upper surface 248 of the second louver 244. This causes the foot 249 of the first louver 242, i.e. the coupling point between panel surface and first louver, to be shaded for incident light (indicated 290) falling under an angle of 45° on the shading panel 200. The light emitting element 23 located in the opening 227 under the second louver 244, may be shaded completely when incident light (referred to as 290) is provided under an angle of 45°. The complete volume of the light emitting element 23 may be positioned within the shade provided by the second louver 244.

Both the first louvers and the second louvers are interrupted between adjacent pairs of openings of adjacent columns 222 of openings. As such a plurality of aligned louver sections 251 respectively 253 are provided, aligned in row direction 234.

The third louver 280 is also interrupted between adjacent pairs of openings of adjacent columns 222 of openings, and is interrupted at half the width of the light emitting element 22 or 23 which it faces. As such a plurality of aligned louver sections 281 are provided, aligned in row direction 234.

The first and third louvers 242 respectively 280, are provided as substantially straight vanes of fins.

The second louver sections 253 are curved, having their radii of curvature 259 oriented downwards, i.e. towards the lower border 214.

In order to reduce incident light falling upon zones of the panel surface other than zones provided by openings for receiving light emitting elements, for each section of the shading panel according to a plane perpendicular to the plane surface and parallel to the column direction, the distance in a direction parallel to the column direction of the point 243 of the intersection of the first louver 242 farthest remote from the panel surface 210 with the intersection of the second louver 242 is less than or equal to height H1 of the first louver 242.

Opposite to the coupling edges 252 respectively 254 of the first and second louver, the louvers 242 respectively 244 have a face surface 256 respectively 258, which is oriented under an angle with the panel surface 210, the face surfaces 256 respectively 258, be facing towards the lower border 214. Also the corresponding face of the third louver 280 may be oriented under an angle with the panel surface 210, facing towards the lower border 214.

For each section of the shading panel according to a plane perpendicular to the plane surface and parallel to the column direction, i.e. plane BB', the section providing an intersection with the first louver 242, the second louver 244 and the light emitting element 226 of the pair of light emitting elements positioned closer to the upper border 212, the imaginary line 270 passing through the point 243 of the intersection of the first louver 242 farthest remote from the panel surface 210 and the point 245 of the intersection of the second louver 244 farthest remote from the panel surface 210 does not intersect with intersection of the light emitting element 22 located in the opening 226.

As best visible in the detail of FIG. 4, the panel surface 210 is provided with a saw-like, serrated surface structure 217. The serration has a triangular cross section, according to a plane perpendicular to the panel surface and parallel to the column direction, with a first face 271 of the triangle parallel to the panel surface 210, the second face 272 oriented substantially perpendicular to the panel surface 210, and the third face 273 making an angle as small as possible with the second face.

It is to be understood that although preferred embodiments, specific constructions and configurations, as well as materials, have been discussed herein for devices according to the present invention, various changes or modifications in form and detail may be made without departing from the scope of this invention as defined by the appended claims. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A shading panel for shading light emitting elements of a light emitting diode display system;

the shading panel defining a substantially plane panel surface having a upper border and a lower border, and comprising at least one column of at least two openings spaced at a pitch and aligned according to a column direction, each opening being suitable to receive at least one light emitting element;

a first shading louver and a second shading louver for each pair of adjacent openings of the at least one column of openings;

the first shading louver being positioned closer to the opening of the pair of openings closest to the upper border;

the second shading louver being positioned closer to the opening of the pair of openings that is closest to the lower border;

the height of the first shading louver being smaller than the height of the second shading louver;

wherein each of the first and second louvers have an upper surface oriented towards the upper border;

the height of the second louver being more than or equal to the difference of the pitch and the minimum distance between the upper surface of the first louver and the upper surface of the second louver.

2. A shading panel according to claim 1, wherein a plurality of openings are positioned on the shading panel surface according to a matrix of N×M openings, comprising M columns of openings oriented according to said column direction and N rows of openings oriented according to a row direction, with M being more than 1.

3. A shading panel according to claim 2, wherein the first louver and/or the second louver are interrupted between adjacent pairs of openings of adjacent columns of openings.

4. A shading panel according to claim 1, wherein the second louver has a curved shape.

5. A shading panel according to claim 4, wherein the radii of curvature of the curved shape are oriented towards the lower border.

6. A shading panel according to claim 1, wherein the shading panel further comprises a third louver positioned between the first louver and the opening of the pair of openings closest to the upper border, the height of the third louver being less than the height of first louver.

7. A display system comprising a shading panel according to claim 1, the display system comprising at least two light emitting elements, each of the at least two openings encompassing one of said at least two light emitting elements.

8. A display system according to claim 7, wherein for each section of the shading panel according to a plane perpendicular to the plane surface and parallel to the column direction and providing an intersection with the first louver, the second louver and the light emitting element of the pair of light emitting elements positioned closer to the upper border, the imaginary line passing through the point of the intersection of the first louver farthest remote from the panel surface and the point of the intersection of the second louver farthest remote from the panel surface does not intersect with intersection of the light emitting element.

9. A display system according to claim 7, wherein a plurality of light emitting elements are positioned on the shading panel surface according to a matrix of N×M light emitting elements, comprising M columns of light emitting elements oriented according to said column direction and N rows of light emitting elements oriented according to a row direction, with M being more than 1.

10. A display system according to claim 9, wherein the first louver and/or the second louver are interrupted between adjacent pairs of light emitting elements of adjacent columns of light emitting elements.

11. A display system according to claim 10, wherein the second louver is interrupted between adjacent pairs of light emitting elements of adjacent columns of light emitting elements providing second louver sections, the second louver sections being curved.

12. A display system according to claim 11, wherein the radii of curvature of the curved shape are oriented towards the lower border.

13. A display system according to claim 7, further comprising a third louver positioned between the first louver and the opening of the pair of openings closest to the upper border, the height of the third louver being less than the height of first louver, the light emitting element of the pair of light emitting elements closest to the upper border.

14. A display system according to claim 7, wherein the second louver shades the light emitting element of the pair of light emitting elements located closer to the bottom border from incident external light falling on the panel surface at a light incident angle between 0° and 45°.

* * * * *